US008462753B2

(12) United States Patent
Eom et al.

(10) Patent No.: US 8,462,753 B2
(45) Date of Patent: Jun. 11, 2013

(54) LOW PROFILE MOBILE TRI-BAND ANTENNA SYSTEM

(75) Inventors: Soon-Young Eom, Daejon (KR); Young-Bae Jung, Daejon (KR); Seong-Ho Son, Daejon (KR); Jae-Seung Yun, Daejon (KR); Soon-Ik Jeon, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 879 days.

(21) Appl. No.: 12/094,354

(22) PCT Filed: Nov. 10, 2006

(86) PCT No.: PCT/KR2006/004698

§ 371 (c)(1),
(2), (4) Date: May 20, 2008

(87) PCT Pub. No.: WO2007/064094

PCT Pub. Date: Jun. 7, 2007

(65) Prior Publication Data

US 2008/0298298 A1 Dec. 4, 2008

(30) Foreign Application Priority Data

Dec. 1, 2005 (KR) ..... 10-2005-0116056
May 26, 2006 (KR) ..... 10-2006-0047743

(51) Int. Cl.
*H04B 7/185* (2006.01)

(52) U.S. Cl.
USPC ..... 370/339; 455/12.1; 455/25

(58) Field of Classification Search
USPC ..... 370/310, 339, 401, 465; 455/12.1, 455/13.1, 13.3, 13.4, 23–25, 427–430; 342/352, 342/354; 343/840, 779
See application file for complete search history.

(56) References Cited

U.S. PATENT DOCUMENTS 5,202,700 A 4/1993 Miller
6,108,561 A * 8/2000 Mallinckrodt ..... 455/522

(Continued)

FOREIGN PATENT DOCUMENTS

JP 2001-007637 1/2001

OTHER PUBLICATIONS

Roederer et al., "Semi-active hybrid antennas for satellites," IEE Colloquium on Hybrid Antennas, May 26, 1993, pp. 1-12.
Soon-Young Eom et al., "A Study on Mobile Antenna System Design with Tri-Band Operation for Broadband Satellite Communications and DBS Reception", Korean Institute of Electromagnetic Engineering and Science, vol. 17, No. 5, pp. 461-475, May 2006.

(Continued)

*Primary Examiner* — Donald Mills
*Assistant Examiner* — Mon Cheri Davenport
(74) *Attorney, Agent, or Firm* — Rabin & Berdo, P.C.

(57) ABSTRACT

Provided is a mobile tri-band antenna system having low profile. The antenna system includes a tri-band feeding unit for dividing a satellite broadcasting signal by a signal channel in an azimuth angle and an elevation angle, and transmitting/receiving the satellite communication signal through distinguishing the satellite communication signal; a beam shaping unit for dividing the satellite broadcasting signals into a first channel signal and a second channel signal, combined power thereof through channel switching; an antenna controlling unit for driving an antenna system in an azimuth and elevation angle to direct the satellite according to the power combined second channel signal from the beam shaping unit; a first triplexer unit for outputting the power combined first channel signal to a rotary joint unit; a second triplexer unit for converting the first channel signal inputted to a downlink frequency and providing the converted first channel signal to the indoor apparatus.

14 Claims, 9 Drawing Sheets

U.S. PATENT DOCUMENTS

| | | | | |
|---|---|---|---|---|
| 6,191,734 | B1 | 2/2001 | Park et al. | |
| 6,512,490 | B1 * | 1/2003 | Lee | 343/882 |
| 2003/0199246 | A1 * | 10/2003 | Friedman et al. | 455/3.01 |
| 2005/0052333 | A1 | 3/2005 | Rao et al. | |
| 2005/0140563 | A1 | 6/2005 | Eom et al. | |
| 2008/0056176 | A1 * | 3/2008 | Hudson et al. | 370/316 |

OTHER PUBLICATIONS

Soon-Young Eom et al., "Design and Test of a Mobile Antenna System with Tri-Band Operation for Broadband Satellite Communications and DBS Reception", IEEE Transactions on Antennas and Propagation, vol. 55, No. 11, pp. 3123-3133, Nov. 2007.

* cited by examiner

LOW PROFILE MOBILE TRI-BAND ANTENNA SYSTEM

TECHNICAL FIELD

The present invention relates to a low profile mobile tri-band antenna system for tracking a satellite by driving an antenna system according to an azimuth angle and an elevation angle, which direct the satellite, using a satellite receiving signal.

BACKGROUND ART

Generally, an antenna structure for an antenna system is selected depending on a performance, a cost, and an environment thereof. That is, the antenna structure must be selected in order to develop a low cost antenna that satisfies a high gain antenna characteristic in a high frequency band and a multi-band which are a communication environment between a satellite and a mobile object.

A conventional antenna system includes a mechanical antenna system and a phased array antenna system.

The mechanical antenna system is mainly used for long distance satellite communication for providing a fixed antenna beam. Especially, the mechanical antenna system is widely used as a low gain single or dual band mobile antenna system because the cost of the mechanical antenna system is affordable. Also, the mechanical antenna system is used as a small antenna having a wide antenna beam using a mechanical tracking scheme in the mobile environment.

The phased array antenna system is mainly used as a military antenna (radar) for accurately and finely tracking a target object because the phased array antenna system is capable of tracking a target object in high speed using an electric beam.

However, the conventional antenna system has following shortcomings.

The mechanical antenna system becomes incapable of tracking a satellite when the antenna beam becomes narrower, for example, narrower than 1.0°, due to the increment of a gain.

Also, a phased array antenna system satisfying a multi-band, a high frequency, a high gain, and a wide beam scan sector is very expensive, and such a phased array antenna system has limitations to embody.

Therefore, there is a demand for developing an antenna system having the advantages of the conventional antenna system, such as a mechanical antenna system and a phased array antenna, with the optimal economical efficiency.

DISCLOSURE

Technical Problem

It is, therefore, an object of the present invention to provide a mobile tri-band antenna system for tracking a target satellite by driving an antenna system according to an azimuth angle and an elevation angle, which direct the target satellite, using a satellite broadcasting receiving signal.

Technical Solution

In accordance with one aspect of the present invention, there is provided a mobile tri-band antenna system having a dual reflecting unit for receiving/transmitting a satellite communication signal from/to a free space, an uplink frequency converting unit for converting the satellite communication transmitting signal to an uplink frequency, a first downlink frequency converting unit for converting the satellite communication receiving signal to a downlink frequency, a first triplexing unit and a second triplexing unit for transmitting and receiving the satellite communication signal, a rotary joint unit for connecting a rotating unit for tracking the satellite and a fixing unit for fixing the antenna system, and an indoor apparatus for controlling the antenna system by a user, the mobile tri-band antenna system including: a tri-band feeding unit for dividing a satellite broadcasting signal received from the dual reflecting unit by a signal channel according to an azimuth angle and an elevation angle, and transmitting/receiving the satellite communication signal through distinguishing the satellite communication signal; a beam shaping unit for dividing the satellite broadcasting signals from the tri-band feeding unit into a first channel signal and a second channel signal, and for combining power of the first channel signal and power of the second channel signal through channel switching; an antenna controlling unit for driving an antenna system according to an azimuth angle and an elevation angle to direct the satellite by the second channel signal from the beam shaping unit; a first triplexer unit for outputting the first channel signal from the beam shaping unit to a rotary joint unit; a second triplexer unit for converting the first channel signal inputted from the rotary joint unit to a downlink frequency and for providing the converted first channel signal to the indoor apparatus.

Advantageous Effects

A mobile tri-band antenna system in accordance with the present invention has following advantages.

The mobile tri-band antenna system according to the present invention can effectively provide a Ku satellite broadcasting service and a Ka/K satellite communication multimedia service by effectively forming a satellite tracking beam using a 2×2 Ku feed array antenna.

Also, the mobile tri-band antenna system according to the present invention can be widely used to embody an antenna system that is mobile-object mountable and has a multi-band and high gain characteristic at a comparative low cost.

Furthermore, the mobile tri-band antenna system according to the present invention can be mounted at a mobile object and effectively receive a Ka/K band satellite multimedia communication service and a Ku band satellite broadcasting service through geo-stationary satellites.

Moreover, the mobile tri-band antenna system can effectively track a target satellite at high speed by driving the antenna system according to an azimuth angle and an elevation angle, which direct the target satellite, by a quasi-monopulse operation using the satellite broadcasting signal.

DESCRIPTION OF DRAWINGS

The above and other objects and features of the present invention will become apparent from the following description of the preferred embodiments given in conjunction with the accompanying drawings, in which.

BEST MODE FOR THE INVENTION

Other objects and aspects of the invention will become apparent from the following description of the embodiments with reference to the accompanying drawings, which is set forth hereinafter.

An antenna system according to the present invention uses a tri-band service satellite that provides a communication and broadcasting signal. That is, the tri-band signal includes a Ka transmitting signal that denotes a k-band satellite communication transmitting signal, a K receiving signal that denotes a K-band satellite communication receiving signal, and a Ku receiving signal that denotes a Ku-band satellite broadcasting signal.

Figure 1:
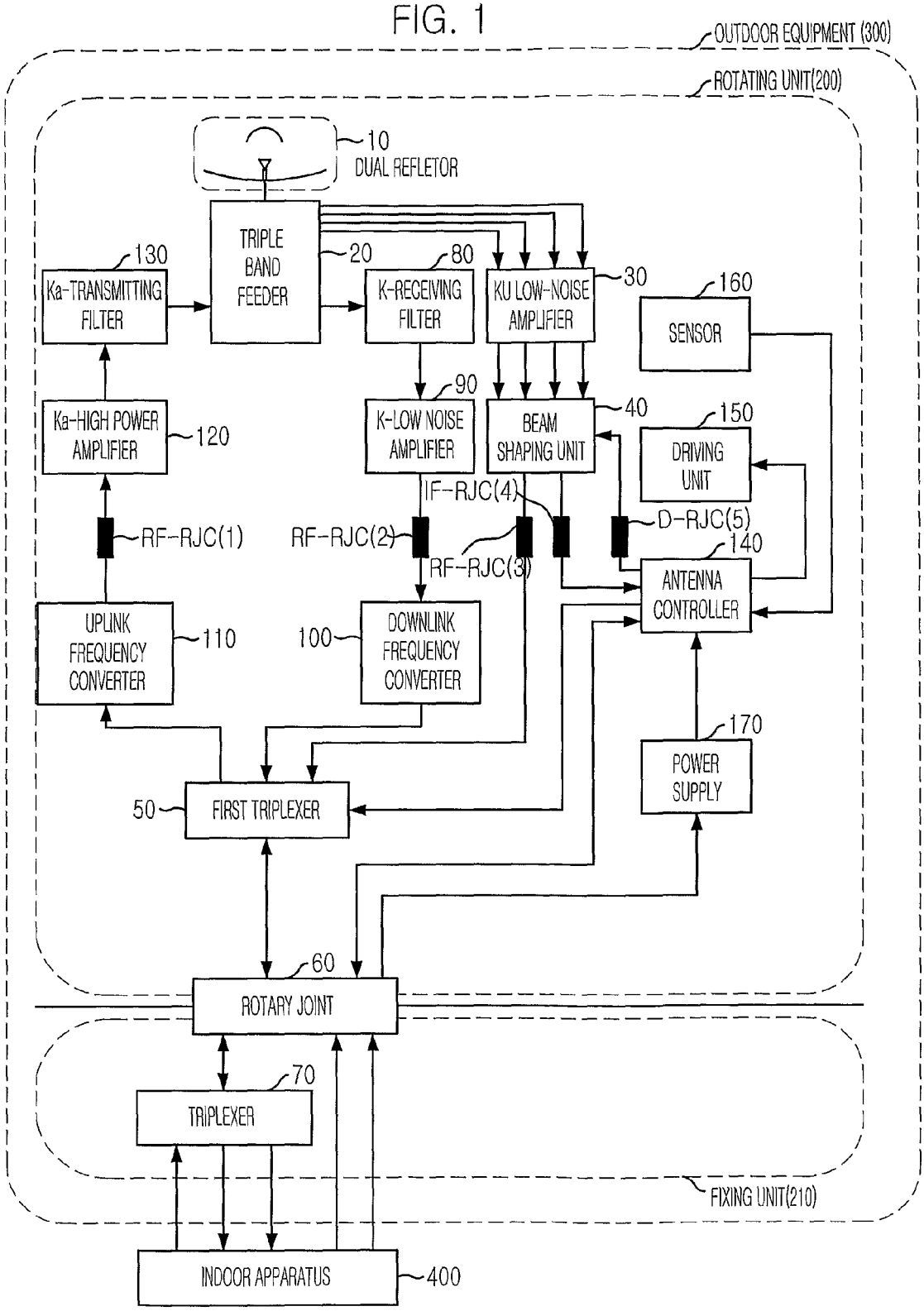
FIG. 1 is a block diagram illustrating a mobile tri-band antenna system in accordance with an embodiment of the present invention.

FIG. 1 is a block diagram illustrating a mobile tri-band antenna system in accordance with an embodiment of the present invention.

Referring to FIG. 1, the mobile tri-band antenna system according to the present embodiment is divided into an outdoor apparatus 300 and an indoor apparatus 400.

The outdoor apparatus 300 includes a rotating unit 200 for tracking a satellite and a fixing unit 210 fixed at a mobile object. The rotating unit 200 includes a dual reflector 10 that refers to a low quasi-offset dual reflector, a tri-band feeder 20, a Ku low noise amplifier 30, a beam shaping unit 40, a first triplexer 50, a rotary joint 60, a K receiving filter 80, a K low noise amplifier 90, a downlink frequency converter 100, an uplink frequency converter 110, a Ka high-power amplifier 120, a Ka transmitting filter 130, an antenna controller 140, a driving unit 150, a sensor unit 160, and a power supply unit 170. The fixing unit 210 includes a second triplexer 70.

The indoor apparatus 400 monitors and controls the outdoor apparatus 300. Especially, the outdoor 400 monitors and controls the levels of transmitting/receiving Intermediate Frequency (IF) signals.

The fixing unit 210 provides an interface to exchange the transmitting/receiving IF signals and the monitoring/controlling signals with the indoor apparatus 400. The rotary joint 60 provides an interface between the rotating unit 200 and the fixing unit 210 for exchanging the transmitting/receiving IF signal, the AC power and the monitoring/controlling signal.

The dual reflector 10 includes a commonly used tri-band feeding structure and is designed to have a low profile, for example, 3.25:1 as a ratio of a width and a height in order to reduce the height of the entire antenna system. Herein, the surface of a main reflector and a sub-reflector in the dual reflector 10 has a predetermined shape designed according to a feeding radiation characteristic of the tri-band feeder 20. Therefore, the antenna system according to the present invention provides a comparative narrow beam, for example, 1.0°, in an azimuth angle, and provides a comparative wider beam, for example, 3.0°, in the elevation angle.

In more detail, the tri-band feeder 20 forms current distribution on the aperture surface of the dual reflector antenna. The main reflector and the sub reflector form a desired beam pattern by reflecting an electromagnetic wave radiated from the tri-band feeder 20, converting the reflective wave to a plane wave, and concentrate an incident plane wave to the tri-band feeder 20.

Also, the antenna system with the dual reflector 10 compensates mechanical tracking errors by providing information about the direction and motion of a mechanical driving unit through electrically tracking a satellite at a high speed using the tri-band feeder 20, that is, the Ku band feeder.

Hereinafter, the flow of Ka, K and Ku signals in the tri-band antenna system will be described.

At first, the Ka transmitting signal flows through the outdoor apparatus 400, the second triplexer 70, the rotary joint 60, the first triplexer 50, the uplink frequency converter 110, the Ka high power amplifier 120, the Ka transmission filter 130, the tri-band feeder 20 and the dual reflector 10.

In more detail, the Ka transmitting signal flows as follows.

Ka transmitting signals are monitored and controlled by the indoor apparatus 400 and inputted to the second triplexer 70.

Then, the second triplexer 70 filters the Ka transmitting signal through an S and L band filter and outputs the filtered signal to the rotary joint 60.

The Ka transmitting signal is outputted to the first triplexer 50 passing through the rotary joint 60. The first triplexer 50 filters the Ka transmitting/receiving signal through an S and L band filter and outputs the filtered signal to the uplink frequency converter 110.

In addition, the uplink frequency converter 110 converts the Ka transmitting signal from an IF signal to a RF signal. Also, the uplink frequency converter 110 makes a desired high frequency local oscillator using a stable internal reference oscillator in the uplink frequency converter 110. Furthermore, the uplink frequency converter 110 outputs alarm data to the antenna controller 140 when the local oscillator is malfunctioned.

Then, the Ka transmitting signal is transferred from the uplink frequency converter 110 to the Ka high power amplifier 120.

In addition, the uplink frequency converter 110 and the Ka high power amplifier 120 are connected through a RF cable such as a RF-RJC1 1 which is flexible and has a low loss characteristic. The flexible RF cable is used because the Ka high power amplifier 20 moves in an elevation angle with being synchronized with the dual reflector 10 although the Ka high power amplifier 20 is separated from the uplink frequency converter 110. However, the uplink frequency converter 110 moves in the azimuth angle with being synchronized with the dual reflector 10.

Meanwhile, the Ka transmitting signal is amplified to have a high power and a high gain by the Ka high power amplifier 120. Then, the Ka transmitting filter 130 filters the amplified signal and outputs the filtered signal to the tri-band feeder 20.

The Ka transmitting filter 120 suppresses the K receiving band characteristics of the Ka signal not to influence to the noise characteristics of the K receiving channel. Also, the Ka transmitting filter 120 includes a WR28 circular waveguide as an output terminal, and the tri-band feeder 20 includes WR28 circular waveguide as an input terminal. Since the WR28 circular waveguide has a function suppressing a receiving frequency band, the Ka transmitting filter 130 may not be required.

Then, the dual reflector 10 radiates the Ka transmitting signal to a free space.

Meanwhile, the K receiving signal flows sequentially through the dual reflector 10, the K receiving filter 80, the K low noise amplifier 90, the downlink frequency converter 100, the first triplexer 50, the rotary joint 60, the second triplexer 70 and the indoor apparatus 400.

In more detail, the K receiving signal flows as follows.

The dual reflector 10 receives the K receiving signal from a free space and outputs the K receiving signal to the tri-band feeder 20.

Then, the tri-band feeder 20 distinguishes the K receiving signal from the Ka transmitting signal and transmits the K receiving signal to the K receiving filter 80.

The K receiving filter 80 filters the K receiving signal. Then, the K low noise amplifier 90 amplifies the K receiving signal to have a low noise and a high gain and outputs the amplified signal to the downlink frequency converter 100.

The K low noise amplifier 90 and the downlink frequency converter 100 are connected through a RF cable, a RF-RJC2 2, which is flexible and has a low loss characteristic. The flexible RF cable is used because the K low noise amplifier 90 moves in the elevation angle with being synchronized with the dual reflector 10 although the K low noise amplifier 90 is separated from the downlink frequency converter 100. However, the downlink frequency converter 100 moves in the azimuth angle with being synchronized with the dual reflector 10.

In addition, the downlink frequency converter 100 converts the K receiving signal from a RF signal to an IF signal. Also, the downlink frequency converter 100 makes a high frequency local oscillator using a stable internal reference oscillator in the downlink frequency converter 100, and outputs alarm data to the antenna controller 140 when the local oscillator is malfunctioned.

Meanwhile, the first triplexer 50 filters the K receiving signal using a S band and L band filter and outputs the filtered signal to the rotary joint 60.

Then, the K receiving signal is outputted to the second triplexer 70 passing through the rotary joint 60.

The second triplexer 70 filters the K receiving signal using an S and L band filter, and outputs the filtered signal to the indoor apparatus 400.

Meanwhile, the Ku receiving signal flows along two paths. That is, as a first path, the Ku receiving signal flows along the dual reflector 10, the Ku low noise amplifier 30, the beam shaping unit 40, the first triplexer 50, the rotary joint 60, the second triplexer 70 and the indoor apparatus 400.

As a second path, the Ku receiving signal flows along the dual reflector 10, the Ku low noise amplifier 30, the beam shaping unit 40, and the antenna controller 140.

In detail, the Ku receiving signal flows as follows.

The dual reflector 10 receives the Ku receiving signal from a free space and outputs the received Ku receiving signal to the tri-band feeder 20.

The tri-band feeder 20 divides the Ku receiving signal into the four channel signals and transfers the four channel signals to the Ku low noise amplifier 30.

Then, the Ku low noise amplifier 30 amplifies the Ku receiving signal to have a low noise and a high gain and outputs the amplified signal to the beam shaping unit 40.

Herein, the beam shaping unit 40 divides the Ku receiving signal into two pairs of four channel signals. One pair of the four channel signals is combined and transmitted along the first path, that is, the first triplexer 50, the rotary joint 60, and the second triplexer 70. Also, the other pair of the four channel signals is combined and transmitted along the second path to the antenna controller 140.

In addition, the beam shaping unit 40 and the first triplexer 50 are connected through a RF cable, RF-RJC3 3, which is flexible and has a low loss characteristic. The flexible RF cable is used because the beam shaping unit 40 moves in the elevation direction with being synchronized with the dual reflector 10 although the first triplexer 50 and the antenna controller 140 are separated from one another. However, the first triplexer 50 and the antenna controller 140 move in the azimuth direction with being synchronized with the dual reflector 10.

Figure 2:
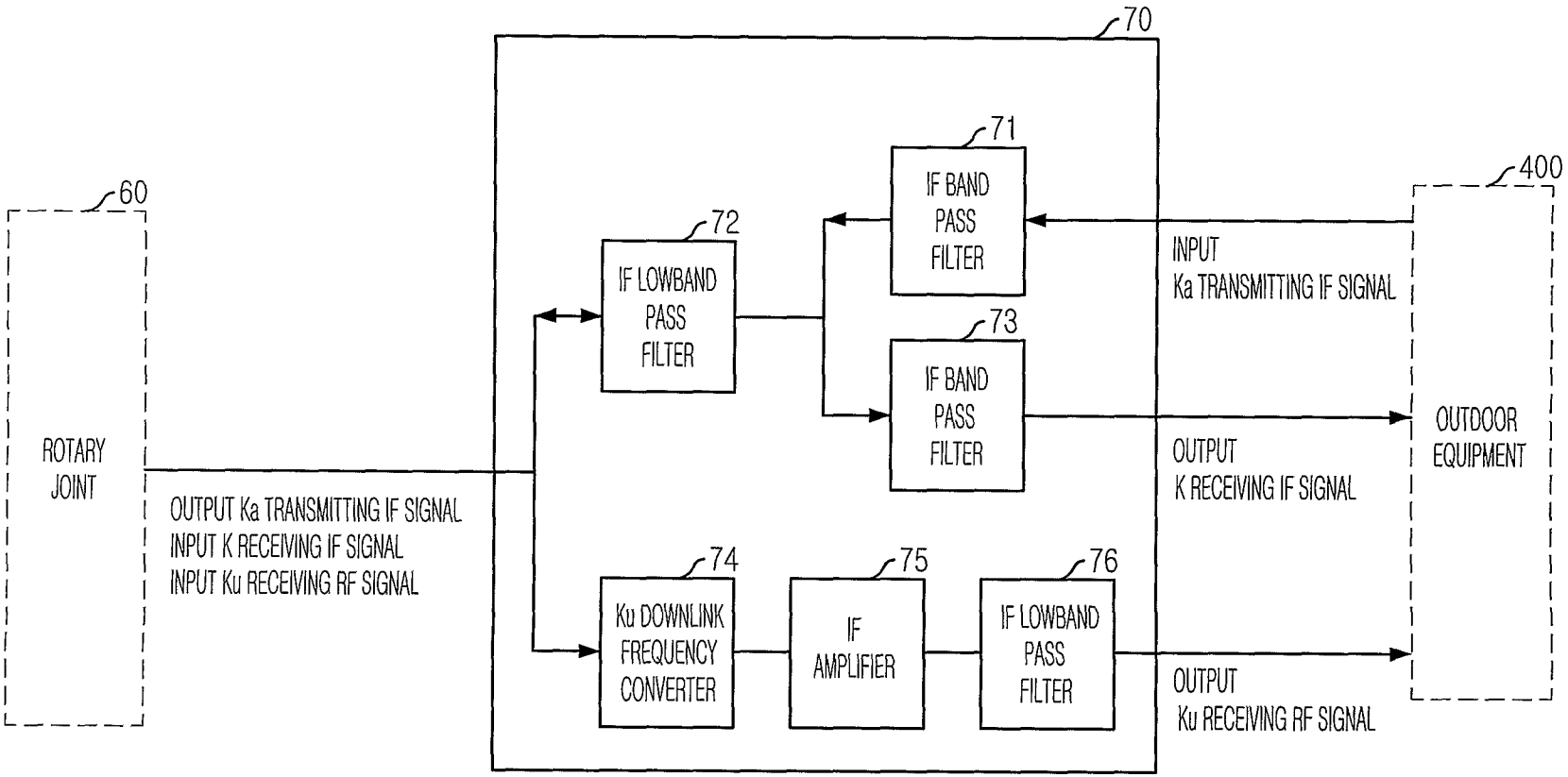
FIG. 2 is a block diagram illustrating a second triplexer in accordance with an embodiment of the present invention.

FIG. 2 is a block diagram illustrating a second triplexer 70 in accordance with an embodiment of the present invention.

As shown in FIG. 2, the second triplexer 70 is connected to the rotary joint 60 and the indoor apparatus 400. Herein, the second triplexer 70 includes three channels to input and output tri-band signals, that is, a Ka transmitting IF signal, a K receiving IF signal, a Ku receiving RF signal, and a Ku receiving IF signal. That is, the second triplexer 70 receives the Ka transmitting IF signal from the indoor apparatus 400 to the rotary joint 60. The second triplexer 70 receives a K receiving IF signal from the rotary joint 60 and outputs the received K receiving IF signal to the indoor apparatus 400. The second triplexer 70 receives a Ku receiving RF signal from the rotary joint 60 and output the Ku receiving IF signal to the indoor apparatus 400.

Meanwhile, the second triplexer 70 selects each interested bands and blocks the other out-bands. Especially, the second triplexer 70 down-converts the Ku receiving RF signal to an L band Ku receiving IF signal.

In more detail, the second triplexer 70 receives the Ka transmitting IF signal from the indoor apparatus 400 and filters the received Ka transmitting IF signal through an IF band pass filter 71 for a S band and an IF low band pass filter 72 for a S and L band. After filtering, the second triplexer 70 outputs the filtered signal to the rotary joint 60. Also, the second triplexer 70 receives the K receiving IF signal from the rotary joint 60 and filters the received K receiving IF signal through an IF low pass filter 72 for a S band and L band and an IF band pass filter 73 for a S band. After filtering, the second triplexer 70 outputs the filtered signal to the indoor apparatus 400. Herein, the IF low pass filter 72 filters the Ka transmitting IF signal for a S band and the K receiving IF signal for a L band and blocks the Ku receiving RF signal.

Meanwhile, the second triplexer 70 performs frequency-transformation and a high gain amplification to convert the Ku receiving RF signal which is a Ku band to the Ku receiving IF signal which is a L band. Then, the second triplexer 70 amplifies the Ku receiving IF signal through the IF amplifier 75 and filters the amplified Ku receiving IF signal through the IF low pass filter 76 for an L band. After filtering, the second triplexer 70 outputs the filtered Ku receiving IF signal to the indoor apparatus 400. Herein, the IF low pass filter 76 is used for blocking the local oscillation frequency of the Ku downlink frequency converter 74.

Figure 3:
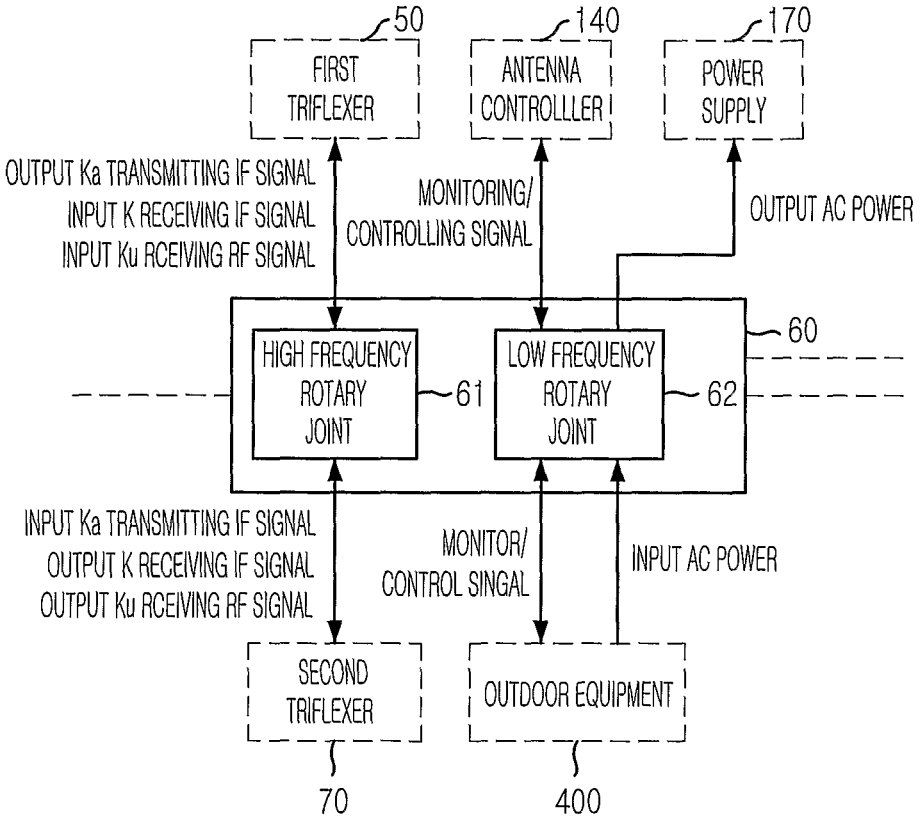
FIG. 3 is a block diagram illustrating a rotary joint in accordance with an embodiment of the present invention.

FIG. 3 is a block diagram illustrating a rotary joint in accordance with an embodiment of the present invention.

Referring to FIG. 3, the rotary joint 60 is connected to a first triplexer 50, a second triplexer 70, an indoor apparatus 400, an antenna controller 140, and a power supply unit 170.

The rotary joint 60 provides an interface for inputting/outputting signals including a Ka transmitting IF signal, a K receiving IF signal and a Ku receiving RF signal, for monitoring/controlling the signals, and for AC power.

In more detail, the rotary joint 60 receives a Ka transmitting IF signal from the second triplexer 70 and outputs the received Ka transmitting IF signal to the first triplexer 50 through the high frequency rotary joint 61. The rotary joint 60 receives the K receiving IF signal and the Ku receiving RF signal from the first triplexer 70 and outputs them to the second triplexer 50 through a high frequency rotary joint 61.

Meanwhile, the rotary joint 60 exchanges the monitoring/controlling signal with the indoor apparatus 400 and the antenna controller 140 through a low frequency rotary joint 62.

The rotary joint 60 receives the AC power from the indoor apparatus 400 and supplies the AC power to the power supply unit 170 through a low frequency rotary joint 62.

Figure 4:
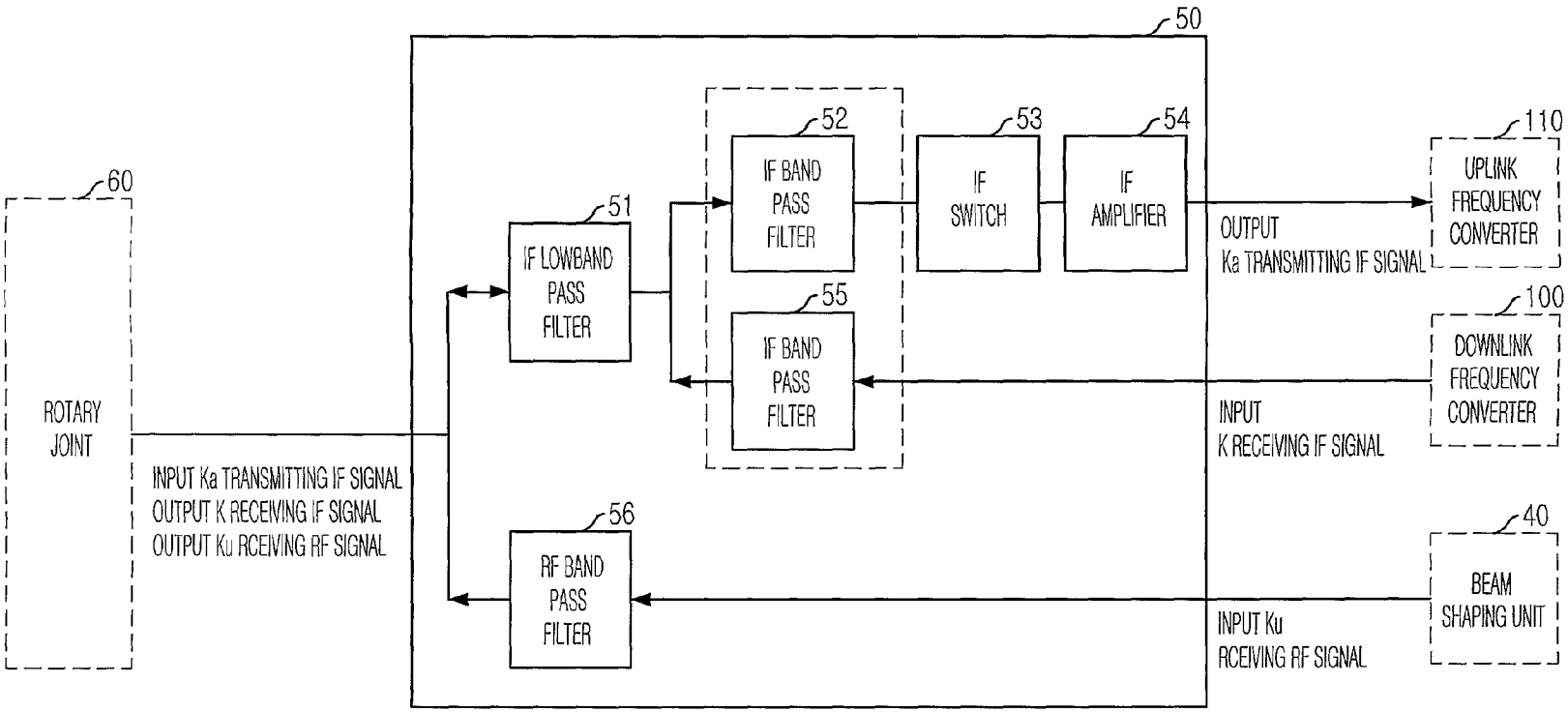
FIG. 4 is a block diagram illustrating a first triplexer in accordance with an embodiment of the present invention.

FIG. 4 is a block diagram illustrating a first triplexer 50 in accordance with an embodiment of the present invention.

Referring to FIG. 4, the first triplexer 50 according to the present embodiment is connected to the rotary joint 60, the uplink frequency converter 110, the downlink frequency converter 100 and the beam shaping unit 40. Herein, the first triplexer 50 makes three channels for inputting/outputting tri-band signals, for example, a Ka transmitting IF signal, a K receiving IF signal, and a Ku receiving RF signal. That is, the first triplexer 50 receives the Ka transmitting IF signal from the rotary joint 60 and outputs the received Ka transmitting IF signal to the uplink frequency converter 110. The first triplexer receives the K receiving IF signal from the downlink frequency converter 100 and outputs the received K receiving IF signal to the rotary joint 60. The first triplexer 50 receives the Ku receiving RF signal from the beam shaping unit 40 and outputs the received Ku receiving RF signal to the rotary joint 60.

Meanwhile, the first triplexer 50 blocks out-band signals. Especially, the first triplexer 50 passes or blocks the Ka transmitting IF signal of an antenna system through turning on/off an IF switch 53.

In more detail, the first triplexer 50 filters the Ka transmitting IF signal through an IF low pass filter 51 for a S and L band and an IF band pass filter 52 for a S band, and outputs the filtered signal to the uplink frequency converter 110 through the IF switch 53 and the IF amplifier 54. Herein, the IF switch 53 is turned on in response to the antenna controller 140 when the antenna system accurately points a target satellite, and is turned off when the antenna system does not point the target satellite.

Also, the first triplexer 50 filters the K receiving IF signal from the downlink frequency converter 100 through an IF band pass filter 55 for L band and an IF low pass filter 51 for S and L band. After filtering, the first triplexer 50 outputs the filtered signal to the rotary joint 60. Herein, the IF low pass filter 51 filters the Ka transmitting IF signal for a S band and the K receiving IF signal for a L band at a corresponding band, and blocks the Ku receiving RF signal.

Meanwhile, the first triplexer 50 receives the Ku receiving RF signal from the beam shaping unit 40 and filters the received Ku receiving RF signal through a RF band pass filter 56 for a Ku band. After filtering, the first triplexer 50 outputs the filtered signal to the rotary joint 60. Herein, the RF band pass filter 56 blocks the Ka transmitting signal and the K receiving IF signal.

Figure 5:
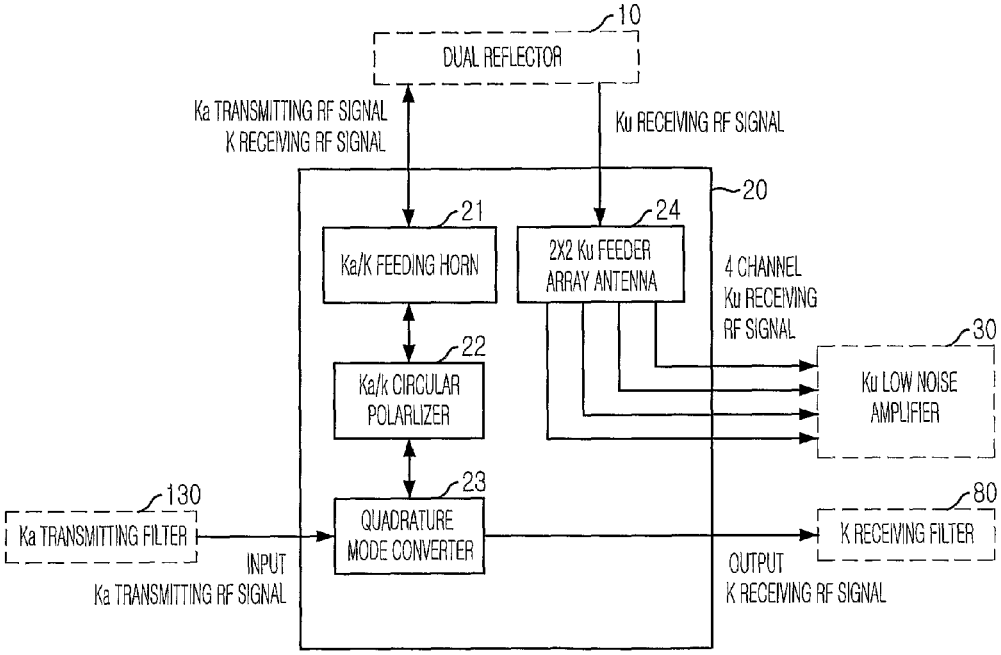
FIG. 5 is a block diagram illustrating a tri-band feeder in accordance with an embodiment of the present invention.

FIG. 5 is a block diagram illustrating a tri-band feeder 20 in accordance with an embodiment of the present invention.

Referring to FIG. 5, the tri-band feeder 20 according to the present embodiment is connected to a dual reflector 10, a Ka transmitting filter 130, a Ku low noise amplifier 30 and a K receiving filter 80.

The tri-band feeder 20 transmits a Ka transmitting RF signal through a Ka/K feeding horns 21 and receives a K receiving RF signal. Especially, the diameter of the Ka/K feeding horn 21 is limited because a 2×2 Ku feed array antenna 24 is disposed around the Ka/K feeding horn 21. Therefore, the Ka/K feeding horn 21 increases a feeding gain by expanding an aperture surface equivalently through inserting a stepped protruding dielectric rod into a circular waveguide of the Ka/K feeding horn 21 in order to effectively feed the dual reflector 10. Herein, the Ka/K feeding horn 21 must be designed to have a dielectric structure for impendence transformation design in order to match impedance.

The tri-band feeder 20 transforms a linear polarized wave, that is, a vertical/horizontal polarized wave signal, to a circular polarized wave signal, which is a left/right circular polarized wave signal, or transforms a circular polarized wave signal to a linear polarized wave signal through a Ka/K circular polarizer 22.

The tri-band feeder 20 discriminates the Ka transmitting RF signal inputted from the Ka transmitting filter 130 from a Ka transmitting filter 130 and a K receiving RF signal inputted from the Ka/K circular polarizer 22 through the ortho-mode transducer 23. For example, the ortho-mode transducer 23 discriminates a vertical polarized component of the Ka transmitting RF signal inputted from the Ka transmitting filter 130 and a horizontal polarized component of the K receiving RF signal inputted from the Ka/K circular polarizer 22.

The tri-band feeder 20 receives a Ku receiving RF signal using a 2×2 Ku feed array antenna 24. Herein, the tri-band feeder 20 outputs the Ku receiving RF signal to the Ku low noise amplifier 30.

In more detail, the tri-band feeder 20 separates a linear polarized wave signal from the Ka transmitting RF signal inputted from the Ka transmitting filter through the ortho-mode transducer 23 and inputs the separated linear polarized wave signal to a Ka/K circular polarizer 22. Then, the tri-band feeder 20 converts the Ka transmitting RF signal, which is separated as a linear polarized wave signal inputted from the Ka/K circular polarizer 22, to a circular polarized wave signal. Then, the tri-band feeder 20 radiates the circular polarized wave signal to the dual reflector 10 through the Ka/K feeding horn 21.

The tri-band feeder 20 inputs the K receiving RF signal, which is the circular polarized wave signal from the dual reflector 10, to the Ka/K circular polarizer 22 through the Ka/K feeding horn 21. Then, the tri-band feeder 20 converts the inputted circular polarized wave of the K receiving RF signal to a linear polarized wave signal. The tri-band feeder 20 separates the linear polarized wave signal, which is the K receiving RF signal, through the ortho-mode transducer 23 and outputs the linear polarized wave signal into the K receiving filter 80.

The tri-band feeder 20 inputs the Ku receiving RF signal inputted from the dual reflector 10 to a 2×2 Ku feeding array antenna. Then, the tri-band feeder 20 outputs four channel Ku RF signals received from the 2×2 Ku feeder array antenna to the Ku low noise amplifier 30.

Figure 6:
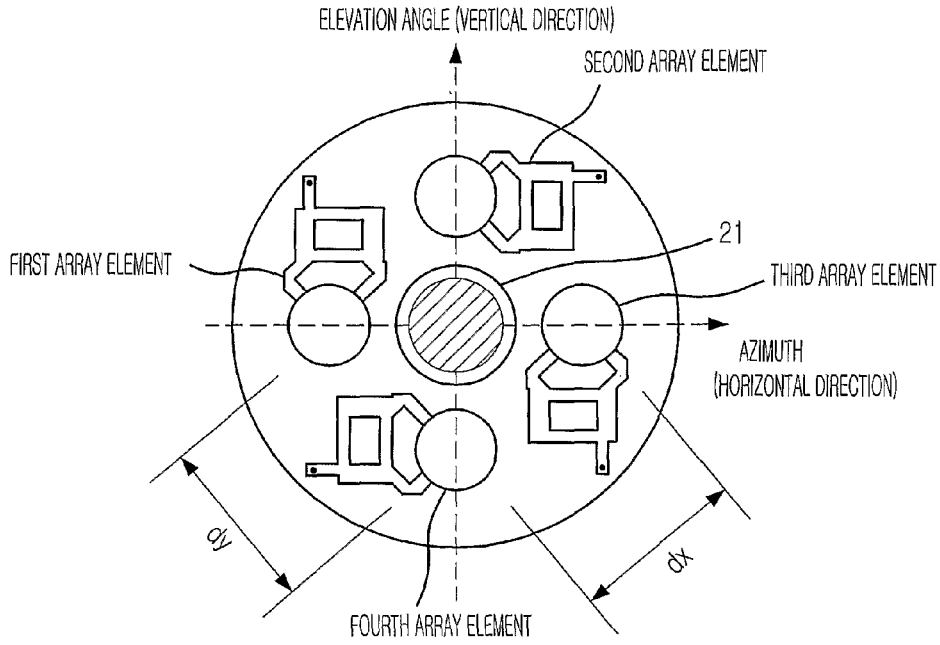
FIG. 6 is a diagram illustrating a first arrangement of a 2×2 Ku feeding array antenna in accordance with an embodiment of the present invention.
Figure 7:
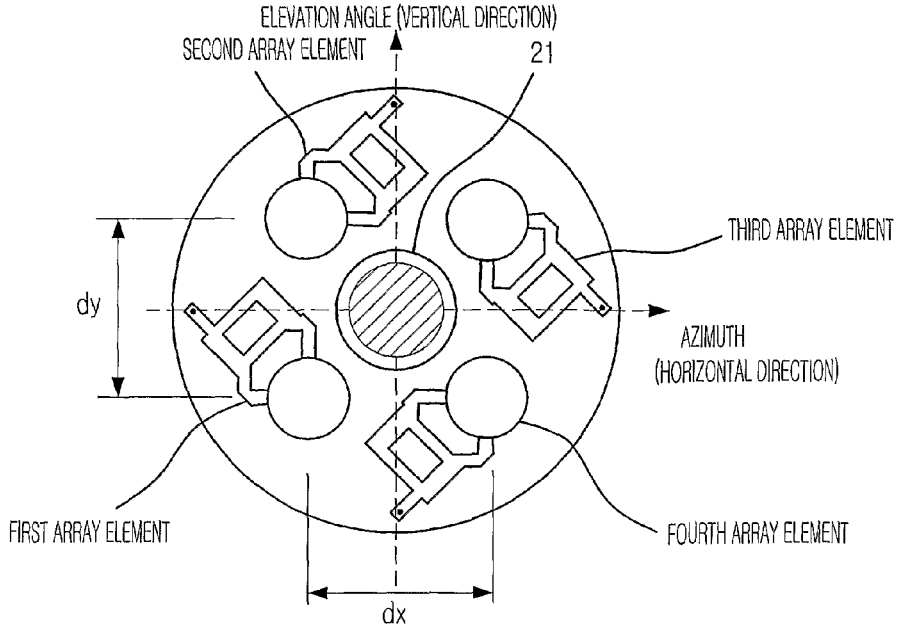
FIG. 7 is a diagram illustrating a second arrangement of a 2×2 Ku feeding array antenna in accordance with an embodiment of the present invention.

FIGS. 6 and 7 are diagrams illustrating a 2×2 Ku feeding array antenna 24 in accordance with an embodiment of the present invention.

Referring to FIGS. 6 and 7, the 2×2 Ku feeding array antenna 24 according to the present invention includes four array elements, that is, a first to a fourth array element, disposed around the Ka/K feeding horn 21 for generating a circular polarized wave signal, as a 90° branch line hybrid coupler.

Herein, it is preferable that the array elements are disposed to be separated one another at a distance dx or dy to be satisfied by dy=dx=0.8$\lambda_0$ in the 2×2 Ku feed array antenna 24. Also, it is preferable to dispose the array element to be rotated at 90° cycle in the 2×2 Ku feed array antenna 24 in order to improve cross polarization characteristic.

Meanwhile, the antenna system captures a satellite tracking direction by comparing the amplitude of the left/right beam of an azimuth plane and the amplitude of the upward/downward beam of an elevation plane in the 2×2 Ku feed array antenna 24. In FIGS. 6 and 7, the two arrangements of the 2×2 Ku feed array antenna 24 are exemplary shown as a first arrangement and a second arrangement according to an azimuth angle and an elevation angle. However, the present invention is not limited thereby. In the first arrangement, the array elements are rotated at 45° for an azimuth angle and an elevation angle compared to a second arrangement.

Hereinafter, the first arrangement and the second arrangement of the 2×2 Ku feed array antenna 24 are compared with reference to Table 1.

| | | Beam offset angle | | Gain [dB] | | | |
|---|---|---|---|---|---|---|---|
| | Selected array element | Azimuth angle | Elevation angle | Antenna direction | Tracking beam direction | Comparative gain degradation | Phase shift |
| First arrangement | Array element 1.2 | +0.85 | 0.0 | 27.3 | 29.3 | −2.0 | 0 |
| | Array element 2.3 | 0.0 | −1.8 | 27.3 | 28.2 | −0.9 | 0 |
| | Array element 3.4 | −0.85 | 0.0 | 27.2 | 29.2 | −2.0 | 180 |
| | Array element 1.4 | 0.0 | +2.2 | 27.2 | 28.3 | −1.1 | 170 |
| Second arrangement | Array element 1 | 0.0 | +3.0 | 25.5 | 27.3 | −1.8 | 0 |
| | Array element 2 | −1.2 | 0.0 | 23.5 | 27.4 | −3.9 | 0 |
| | Array element 3 | 0 | −2.6 | 25.3 | 26.8 | −1.5 | 163 |
| | Array element 4 | +1.2 | 0.0 | 23.4 | 27.3 | −3.9 | 180 |

Referring to Table 1, the first arrangement forms a left beam through array elements 1 and 2 and forms a right beam through array elements 3 and 4. Also, the first arrangement forms an upward beam through array elements 2 and 3 and a downward beam through array elements 1 and 4.

On the contrary, the second arrangement forms a left, a right, an upward and a downward beam through one of array elements. That is, the second arrangement forms a left bema through an array element 2, forms a right beam through an array element 4, forms an upward beam through an array element 1 and forms a downward beam through an array element 3.

Figure 8:
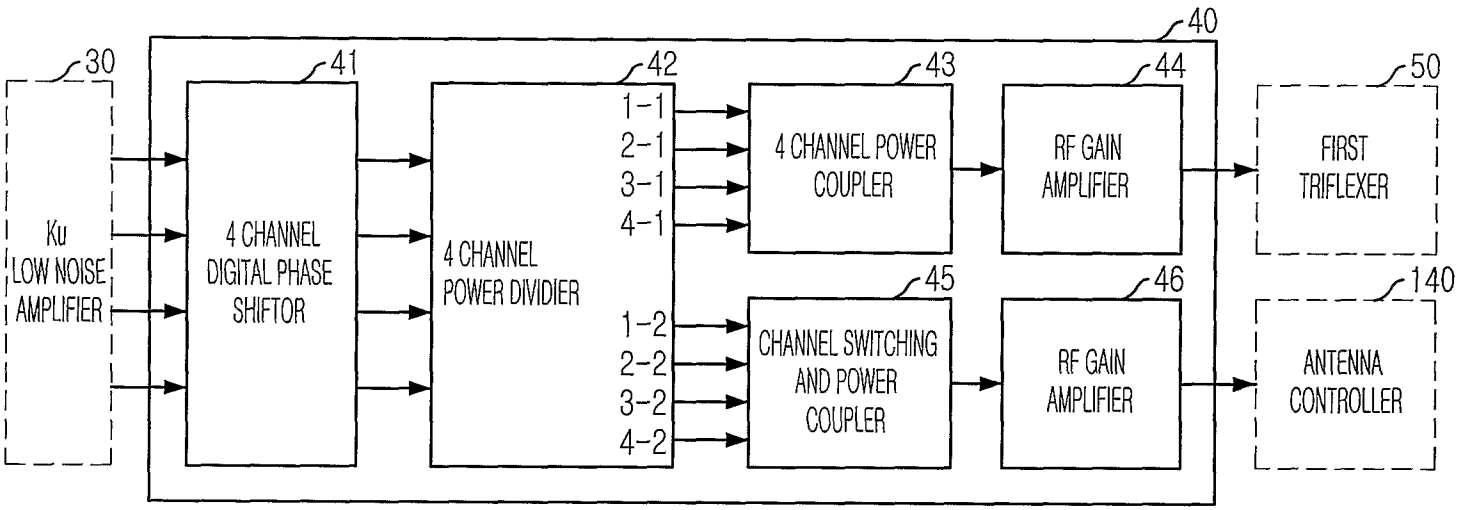
FIG. 8 is a block diagram illustrating a beam shaping unit in accordance with an embodiment of the present invention.

FIG. 8 is a block diagram illustrating a beam shaping unit 40 in accordance with an embodiment of the present invention.

As shown in FIG. 8, the beam shaping unit 40 receives four channel Ku receiving RF signals, which are low noise and high gain amplified signals by the Ku low noise amplifier 30, through a four channel digital phase shifter 41. Herein, the four channel digital phase shifter 41 corrects a phase difference among array elements disposed at 90° cycle and a phase difference made due to designing, manufacturing, and assembling of four active channels in order to improve a cross polarization characteristic.

Then, the beam shaping unit 40 divides the four channel Ku receiving RF signals from the 4 channel digital phase shifter 41 into two pairs of four channel signals using a 4 channel power divider 42.

Meanwhile, the beam shaping unit 40 combines the power of one of the two pairs of four channels through a 4 channel power combiner 43 and amplifies the power-combined signal to have a high-gain through a RF gain amplifier 44. Then, the beam shaping unit 40 outputs the amplified signal to the first triplexer 50. The Ku receiving RF signal becomes a major beam signal for watching a satellite broadcasting TV.

Also, the beam shaping unit 40 uses the other pair of four channel signals to form a satellite tracking beam. That is, the beam shaping unit 40 combines the power of the other pair of four channel signals by switching a channel in a unit of two channels according to the first arrangement of the 2×2 Ku feed array antenna 24 or by switching a channel in a unit of one channel according to the second arrangement of the 2×2 Ku feed array antenna 24 using a channel switching and power combiner 45. After power-combining, the beam shaping unit 40 amplifies the gain of the power combined signals and outputs the amplified signals to the antenna controller 140. Herein, the beam shaping unit 40 provides a satellite tracking signal to the antenna controller 140 of the satellite tracking receiver 142 by transforming the Ku receiving RF signal outputted from the antenna controller 140 to a tracking beam channel.

Figure 9:
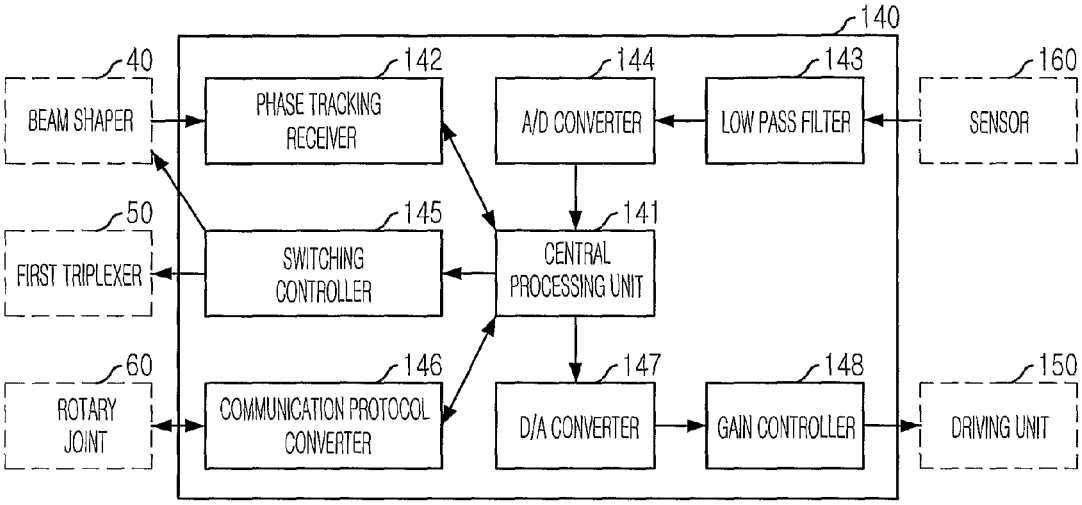
FIG. 9 is a block diagram illustrating an antenna controller in accordance with an embodiment of the present invention.

FIG. 9 is a block diagram illustrating an antenna controller 140 in accordance with an embodiment of the present invention.

As shown in FIG. 9, the antenna controller 140 controls the constitutional elements by receiving corresponding information from other constitutional elements in the antenna system.

The antenna controller 140 exchanges monitoring/controlling signals with a low frequency rotary joint 62 of the rotary joint 60 through a communication protocol converter 146. The antenna controller 140 is controlled by a user at the indoor apparatus 400.

Meanwhile, the antenna controller 140 performs an A/D conversion on the signal intensity of a predetermined frequency band in the Ku receiving RF signal inputted from the beam shaping unit 40 through the satellite tracking receiver 142.

Also, in the antenna controller 140, the central processing unit 141 controls the channel switching and power combiner 45 of the beam shaping unit 40, and the IF switch 53 of the first triplexer 50 through the switch controller 145.

Also, the antenna controller 140 provides signals to the central processing unit 141 by removing the electrical noise of signals inputted from the sensor unit 160 through a low band pass filter 143 and performing the A/D conversion through the A/D converter 144 so as to perform various computations required for controlling the antenna system.

Furthermore, the antenna controller 140 performs a D/A conversion on the output signal from the central processing unit 141 using a D/A converter 147 and control the gain of the D/A converted output signal through a gain controller 148. After controlling the gain, the antenna controller 140 transfers the gain controlled signal to the driving unit 150.

Figure 10:
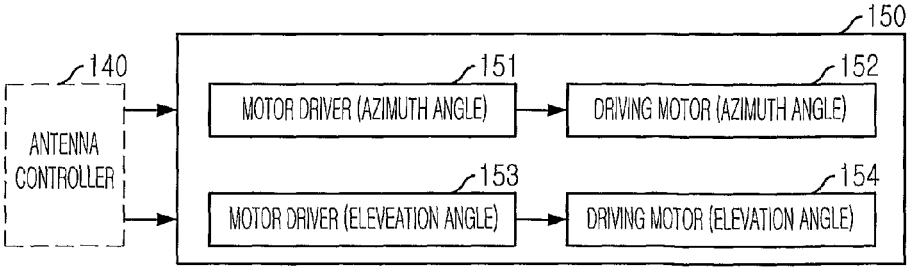
FIG. 10 is a block diagram illustrating a driving unit in accordance with an embodiment of the present invention.

FIG. 10 is a block diagram illustrating a driving unit 150 in accordance with an embodiment of the present invention.

As shown in FIG. 10, the driving unit 150 mechanically drives the antenna system in the azimuth angle and the elevation angle according to the signals inputted from the antenna controller 140. That is, the driving unit 150 drives the inputted signal from the gain controller 140 of the antenna controller 140 in the azimuth angle through an azimuth angle motor driver 151 and an azimuth angle driving motor 152. Also, the driving unit 150 drives the inputted signal from the gain controller 148 of the antenna controller 140 in the elevation angle through an elevation angle motor driver 153 and an elevation driving motor 154.

Figure 11:
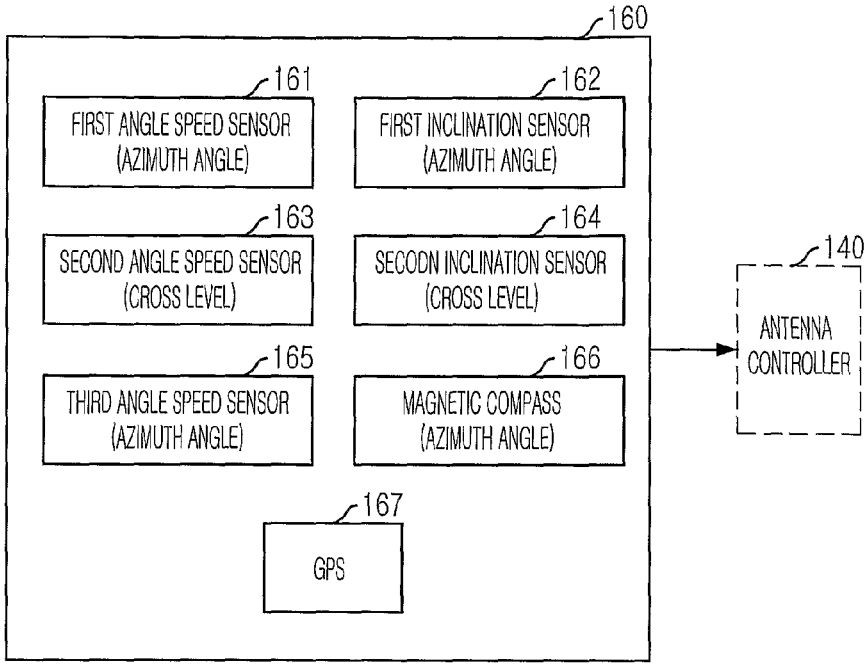
FIG. 11 is a block diagram illustrating a sensor unit in accordance with an embodiment of the present invention.

FIG. 11 is a block diagram illustrating a sensor 160 in accordance with an embodiment of the present invention.

As shown in FIG. 11, the sensor unit 160 measures motion disturbance caused by yawing, rolling and pitching of a mobile object mounted at the antenna system and provides the measured result to the antenna controller 140. That is, the sensor unit 160 measures an angular velocity and an inclination for the elevation angle of the antenna system through a first angular velocity sensor 161 and a first inclination sensor 162. Also, the sensor unit 160 measures the angular velocity and the inclination for the cross level of the antenna system through a second angular velocity sensor 161 and a second inclination sensor 164. Furthermore, the sensor unit 160 measures an angular velocity and a direction for the azimuth angle direction of the antenna system through a third angular sensor 165 and a magnetic compass 166. Also, the sensor unit 160 measures the current location of the antenna system through a global positioning system (GPS) 167.

Figure 12:
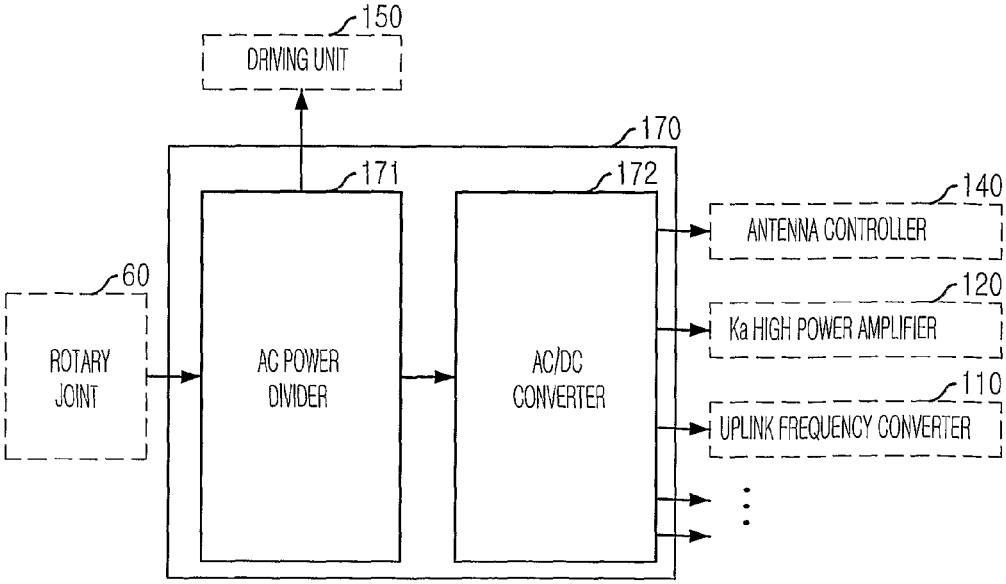
FIG. 12 is a block diagram illustrating a power supply unit in accordance with an embodiment of the present invention.

FIG. 12 is a block diagram illustrating a power supply unit 170 in accordance with an embodiment of the present invention.

As shown in FIG. 12, the power supply unit 170 divides AC power received from the low frequency rotary joint 62 of the rotary joint 60 into a plurality of AC power terminals through an AC power divider 171. Herein, the power supply unit 170 receives one of the divided AC power from the AC power divider 171 and converts the received AC power to DC power through an AC/DC converter 172.

Also, the power supply unit 170 provides one of the divided AC power from the AC power divider 171 to the motor drivers 151 and 153 of the driving unit 150. Furthermore, the power supply unit 170 supplies DC power to the antenna controller 140, the Ka high power amplifier 120, and the uplink frequency converter 110 by the AC/DC converter 172.

While the present invention has been described with respect to certain preferred embodiments, it will be apparent to those skilled in the art that various changes and modifications may be made without departing from the scope of the invention as defined in the following claims.

What is claimed is:

1. A mobile tri-band antenna system, comprising:

an indoor apparatus for controlling the antenna system; and an outdoor apparatus including a rotating unit for tracking a satellite, a fixing unit for fixing the outdoor apparatus, and a rotary joint means for connecting the rotating unit and the fixing unit, the outdoor apparatus including:

a dual reflecting means for receiving first and second frequency band satellite signals from the satellite, and transmitting a third frequency band satellite signal to the satellite;

a tri-band feeding means for dividing the first frequency band satellite signal as received from the dual reflecting means into a plurality of channel signals, receiving the second frequency band satellite signal, and transmitting the third frequency band satellite signal, wherein the tri-band feeding means includes a feeding horn means for transmitting and receiving the second and third frequency band satellite signals with the dual reflecting means, the feeding horn means including a stepped protruding dielectric rod inserted into a circular waveguide for impedance matching, a polarization converting means for converting a linear polarized wave signal to a circular polarized wave signal and vice versa, an identifying means for identifying the second and third frequency band satellite signals, and a feed array means for dividing the first frequency band satellite signal into a signal of a first channel in a horizontal direction of the azimuth angle and a signal of a second channel in a vertical direction of the elevation angle, according to an arrangement of feed array elements of the feed array means;

a beam shaping means for further dividing the plurality of channel signals into a plurality of first channel signals and a plurality of second channel signals, and combining power of the plurality of first channel signals and power of the plurality of second channel signals through channel switching;

an antenna controlling means for driving the antenna system according to the azimuth angle and the elevation angle to direct the satellite according to the power-combined second channel signals from the beam shaping means;

a downlink frequency means for converting the second frequency band satellite signal to a first downlink frequency;

an uplink frequency means for converting the third frequency band satellite signal to an uplink frequency;

a first triplexing means for outputting the power-combined first channel signals from the beam shaping means to the rotary joint means; and a second triplexing means for converting the power-combined first channel signals, inputted from the rotary joint means, to a second downlink frequency and providing the converted first channel signals to the indoor apparatus.

2. The mobile tri-band antenna system as recited in claim 1, wherein the beam shaping means includes:

a channel dividing means for further dividing the plurality of channel signals, from the tri-band feeding means, into the plurality of first channel signals and the plurality of second channel signals;

a first power combining means for combining the power of the plurality of first channel signals; and a second power combining means for combining the power of the plurality of second channel signals.

3. The mobile tri-band system as recited in claim 1, further comprising:

a driving means for mechanically driving the antenna system in a direction of the satellite according to a horizontal direction of the azimuth angle and a vertical direction of the elevation angle;

wherein the antenna controlling means includes a switching means for controlling the third frequency band satellite signal to be turned on or off by driving the antenna system to direct the satellite through the driving means; and a central processing means for controlling the driving means according to the power-combined second channel signals inputted from the beam shaping means.

4. The mobile tri-band antenna system as recite in claim 1, wherein the first triplexing means includes an IF low band pass filter, an IF band pass filter, and an IF amplifier for transmitting the third frequency band satellite signal, and an IF switch disposed between the IF band pass filter and the IF amplifier and being controlled by the antenna controlling means.

5. The mobile tri-band system as recited in claim 1, wherein the second triplexing means includes an IF amplifier and an IF low band pass filter for receiving the power-combined first signal channel signals, and a second downlink frequency means for converting the power-combined first signal channel signals to the second downlink frequency before the IF amplifier.

6. The mobile tri-band system as recited in claim 1, wherein, in the feed array means, the array elements are disposed around the feeding horn means at 90° cycle, and a distance between the array elements is $dy=dx=0.8\lambda_0$.

7. The mobile tri-band system as recited in claim 2, wherein the beam shaping means further includes a phase shifting means for shifting a phase of the divided first frequency band satellite signal from the tri-band feeding means in order to correct a phase difference of array elements, and a phase difference made by dividing the divided first frequency band satellite signal into the first and second signal channels.

8. A mobile tri-band antenna system, comprising:

an indoor apparatus for controlling the antenna system; and an outdoor apparatus including a rotating unit that tracks a satellite, a fixing unit fixing the outdoor apparatus, and a rotary joint connecting the rotating unit and the fixing unit, the outdoor apparatus including:

a dual reflector receiving first and second frequency band satellite signals from the satellite, and transmitting a third frequency band satellite signal to the satellite, a tri-band feeder receiving first and second frequency band satellite signals from the dual reflector, dividing the received first frequency band satellite signal into a plurality of channel signals, and transmitting the third frequency band satellite signal, wherein the tri-band feeder includes a feeding horn transmitting and receiving the second and third frequency band satellite signals with the dual reflector, the feeding horn including a stepped protruding dielectric rod inserted into a circular waveguide for impedance matching, a polarization converter means for converting a linear polarized wave signal to a circular polarized wave signal and vice versa, an identifying means for identifying the second and third frequency band satellite signals, and a feed array antenna for dividing the first frequency band satellite signal into a signal of a first channel in a horizontal direction of the azimuth angle and a signal of a second channel in a vertical direction of the elevation angle, according to an arrangement of feed array elements of the feed array means;

a beam shaping unit further dividing the plurality of channel signals into a plurality of first channel signals and a plurality of second channel signals, and combining power of the plurality of first channel signals and power of the plurality of second channel signals through channel switching, an antenna controller driving the antenna system according to the azimuth angle and the elevation angle to direct the satellite according to the power-combined second channel signals, a downlink frequency converter converting the second frequency band satellite signal to a first downlink frequency, an uplink frequency converter converting the third frequency band satellite signal to an uplink frequency, a first triplexer outputting the power-combined first channel signals to the rotary joint, and a second triplexer receiving the power-combined first channel signals from the rotary joint, converting the received first channel signals to a second downlink frequency, and providing the converted first channel signals to the indoor apparatus.

9. The mobile tri-band antenna system as recited in claim 8, wherein the beam shaping unit includes a channel divider further dividing the plurality of channel signals into the plurality of first channel signals and the plurality of second channel signals, a first power combiner combining the power of the plurality of first channel signals, and a second power combiner combining the power of the plurality of second channel signals.

10. The mobile tri-band system as recited in claim 8, further comprising a mechanical driving unit mechanically driving the antenna system in a direction of the satellite according to a horizontal direction of the azimuth angle and a vertical direction of the elevation angle; wherein the antenna controller includes a switching controller controlling the third frequency band satellite signal to be turned on or off by driving the antenna system to direct the satellite through the driving means, and a central processing unit controlling the mechanical driving unit according to said power-combined second channel signals.

11. The mobile tri-band antenna system as recite in claim 8, wherein the first triplexer includes an IF low band pass filter, an IF band pass filter, and an IF amplifier for transmitting the third frequency band satellite signal, and an IF switch disposed between the IF band pass filter and the IF amplifier and being controlled by the antenna controller.

12. The mobile tri-band system as recited in claim 8, wherein the second triplexer includes an IF amplifier and an IF low band pass filter for receiving the power-combined first signal channel signals, and a second downlink frequency converter converting the power-combined first signal channel signals to the second downlink frequency before the IF amplifier.

13. The mobile tri-band system as recited in claim 8, wherein said array elements are disposed around the feeding horn at 90° cycle, and a distance between the array elements is $dy=dx=0.8\lambda_0$.

14. The mobile tri-band system as recited in claim 9, wherein the beam shaping unit further includes a phase shifter shifting a phase of said divided first frequency band satellite signal in order to correct a phase difference of array elements, and a phase difference made by dividing the divided first frequency band satellite signal into the first and second signal channels.

* * * * *